US008205715B1

(12) United States Patent
Lai

(10) Patent No.: US 8,205,715 B1
(45) Date of Patent: Jun. 26, 2012

(54) MUFFLER COMBINATION

(76) Inventor: Jhen Yang Lai, Changhua (TW)

( * ) Notice: Subject to any disclaimer, the term of this patent is extended or adjusted under 35 U.S.C. 154(b) by 0 days.

(21) Appl. No.: 13/134,778

(22) Filed: Jun. 15, 2011

(51) Int. Cl.
*F01N 1/02* (2006.01)

(52) U.S. Cl. ..... 181/250; 181/212; 181/227; 181/228

(58) Field of Classification Search ..... 181/250, 181/227, 228, 212, 239, 238, 240
See application file for complete search history.

(56) References Cited

U.S. PATENT DOCUMENTS

| | | | | |
|---|---|---|---|---|
| 3,495,680 | A * | 2/1970 | Willette | 181/232 |
| 3,738,089 | A | 6/1973 | Brill | |
| 3,824,790 | A | 7/1974 | Thomaides | |
| 4,134,472 | A | 1/1979 | Trainor | |
| 4,192,404 | A | 3/1980 | Nakagawa et al. | |
| 4,213,414 | A | 7/1980 | Sato et al. | |
| 4,318,720 | A | 3/1982 | Hoggatt | |
| 4,415,059 | A * | 11/1983 | Hayashi | 181/250 |
| 6,889,499 | B2 * | 5/2005 | Bassani | 60/312 |
| 7,584,821 | B2 * | 9/2009 | Prior et al. | 181/241 |
| 7,854,297 | B2 * | 12/2010 | Scanlon | 181/250 |
| 7,942,239 | B2 * | 5/2011 | Huff et al. | 181/266 |
| 8,083,026 | B1 * | 12/2011 | Butler | 181/264 |

* cited by examiner

*Primary Examiner* — Forrest M Phillips
(74) *Attorney, Agent, or Firm* — Charles E. Baxley

(57) ABSTRACT

A muffler combination includes two pipe units each having a cylindrical shell and having an entrance and an exit, an inlet tube connected to the entrance, an outlet tube connected to the exit, and a housing engaged in each of the cylindrical shells, the housings each include three openings formed on one side and two orifices formed on the other side, the cylindrical shells are disposed parallel to each other, and the entrance and the inlet tube of one of the cylindrical shells is located closer to the exit and the outlet tube of the other cylindrical shell whose entrance and inlet tube are located closer to the exit and the outlet tube of the cylindrical shell.

5 Claims, 5 Drawing Sheets

MUFFLER COMBINATION

BACKGROUND OF THE INVENTION

1. Field of the Invention

The present invention relates to a muffler combination for vehicles, and more particularly to a muffler combination for vehicles including an improved structure for suitably reducing the sound or noise that may be generated by the muffler and for suitably facilitating the outward flowing of the exhaust gas.

2. Description of the Prior Art

Typical mufflers for vehicles comprise one or more housings or receptacles each having a number of air perforations formed therein for allowing the exhaust gas to flow through the air perforations and to decrease or reduce the sound or noise that may be generated by the muffler.

For example, U.S. Pat. No. 3,738,089 to Brill, U.S. Pat. No. 3,824,790 to Thomaides, U.S. Pat. No. 4,134,472 to Trainor, U.S. Pat. No. 4,192,404 to Nakagawa et al., U.S. Pat. No. 4,213,414 to Sato et al., and U.S. Pat. No. 4,318,720 to Hoggatt disclose several of the typical mufflers each comprising a housing having one end connected to the exhaust pipe of the vehicles or boats, and a perforated pipe disposed within the housing and supported by the housing, and the perforated pipe is in communication with the exhaust pipe such that the perforations form a resonance chamber between the housing and the exhaust pipe.

However, the typical mufflers comprise a complicated structure that may not be easily manufactured, and that may include a greatly increased manufacturing cost.

The present invention has arisen to mitigate and/or obviate the afore-described disadvantages of the conventional mufflers for vehicles.

SUMMARY OF THE INVENTION

The primary objective of the present invention is to provide a muffler combination including an improved structure for suitably reducing the sound or noise that may be generated by the muffler and for suitably facilitating the outward flowing of the exhaust gas.

In accordance with one aspect of the invention, there is provided a muffler combination comprising a first pipe unit including a first cylindrical shell having a first chamber formed therein, and including an entrance and an exit, and including an inlet tube connected to the entrance, and including an outlet tube connected to the exit, and including a first housing engaged in the first chamber of the first cylindrical shell, the first housing including a first side having three openings formed therein and including a second side having two orifices formed therein, and a second pipe unit including a second cylindrical shell having a second chamber formed therein, and including an entrance and an exit, and including an inlet tube connected to the entrance, and including an outlet tube connected to the exit, and including a second housing engaged in the second chamber of the second cylindrical shell, the second housing including a first side having three openings formed therein and including a second side having two orifices formed therein, and the first cylindrical shell and the second cylindrical shell being disposed parallel to each other, and the entrance and the inlet tube of the first cylindrical shell being located closer to the exit and the outlet tube of the second cylindrical shell, and the entrance and the inlet tube of the second cylindrical shell being located closer to the exit and the outlet tube of the first cylindrical shell.

The openings of the first housing include a diameter of about one-half of a diameter of the first housing. The openings of the second housing include a diameter of about one-half of a diameter of the second housing.

The orifices of the first housing include a diameter of about one-half of a diameter of the first housing. The orifices of the second housing include a diameter of about one-half of a diameter of the second housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
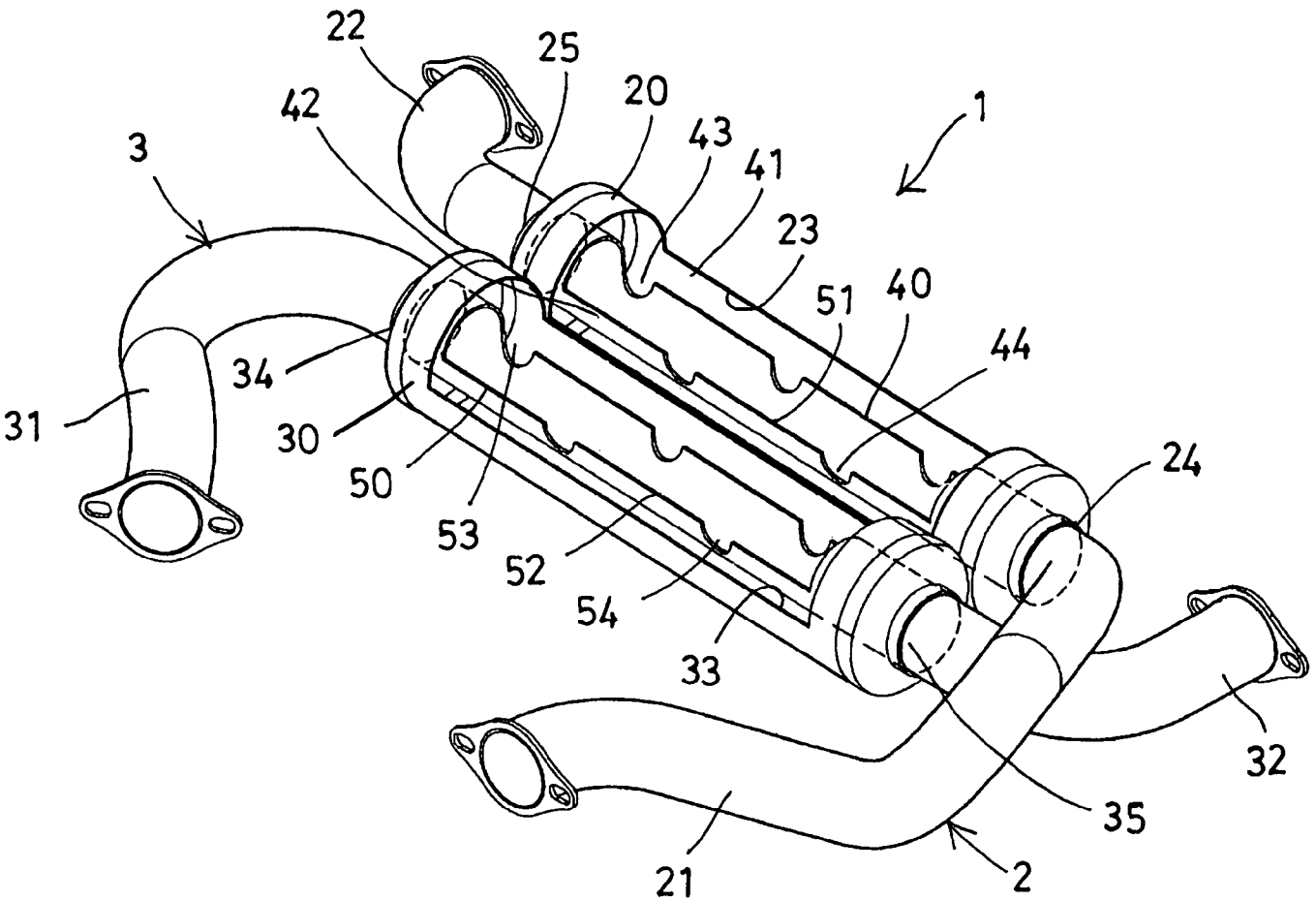
FIG. 1 is a perspective view of a muffler combination in accordance with the present invention.

Referring to the drawings, and initially to FIGS. 1, 2, 3, and 4, a muffler combination 1 in accordance with the present invention comprises two pipe units 2, 3 each including an outer hollow cylindrical shell 20, 30, an inlet tube 21, 31 connected or coupled to the cylindrical shell 20, 30 respectively for connecting or coupling to a tail or exhaust pipe of a vehicle (not shown) and for receiving the exhaust gas from the tail or exhaust pipe of the vehicle and for guiding or supplying the exhaust gas into the cylindrical shell 20, 30 respectively, and an outlet tube 22, 32 connected or coupled to the cylindrical shell 20, 30 respectively for allowing the exhaust gas to be guided to flow out of the cylindrical shell 20, 30 respectively.

The cylindrical shells 20, 30 of the pipe units 2, 3 each include an outer diameter greater than an outer diameter of the inlet tubes 21, 31 and the outlet tubes 22, 32, and each include a chamber 23, 33 formed therein, and each include an entrance 24, 34 for connecting or coupling to the inlet tubes 21, 31 respectively, and each include an exit 25, 35 for connecting or coupling to the outlet tubes 22, 32 respectively, the cylindrical shells 20, 30 are disposed or attached or mounted or secured together and disposed or arranged parallel to each other for allowing the pipe units 2, 3 to form a substantially X-shaped structure, in which the entrance 24 of the cylindrical shell 20 is located closer to the exit 35 of the other cylindrical shell 30, and the entrance 34 of the other cylindrical shell 30 is located closer to the exit 25 of the cylindrical shell 20.

The pipe units 2, 3 each further include an inner pipe or tube or housing 40, 50 disposed or attached or mounted or secured or received or engaged in the chamber 23, 33 of the cylindrical shell 20, respectively, and disposed or arranged parallel to the cylindrical shell 20, 30 respectively, and connected or coupled between the entrance 24, 34 and the exit 25, 35 of the cylindrical shell 20, 30 respectively. The housings

40, 50 each include a first side 41, 51 and an opposite second side 42, 52, in which the exhaust gas may mostly flow onto the first side 41, 51 than the second side 42, 52, and the housings 40, 50 each include three openings 43, 53 formed in the first side 41, 51 thereof, and two orifices 44, 54 formed in the second side 42, 52 thereof.

Figure 2:
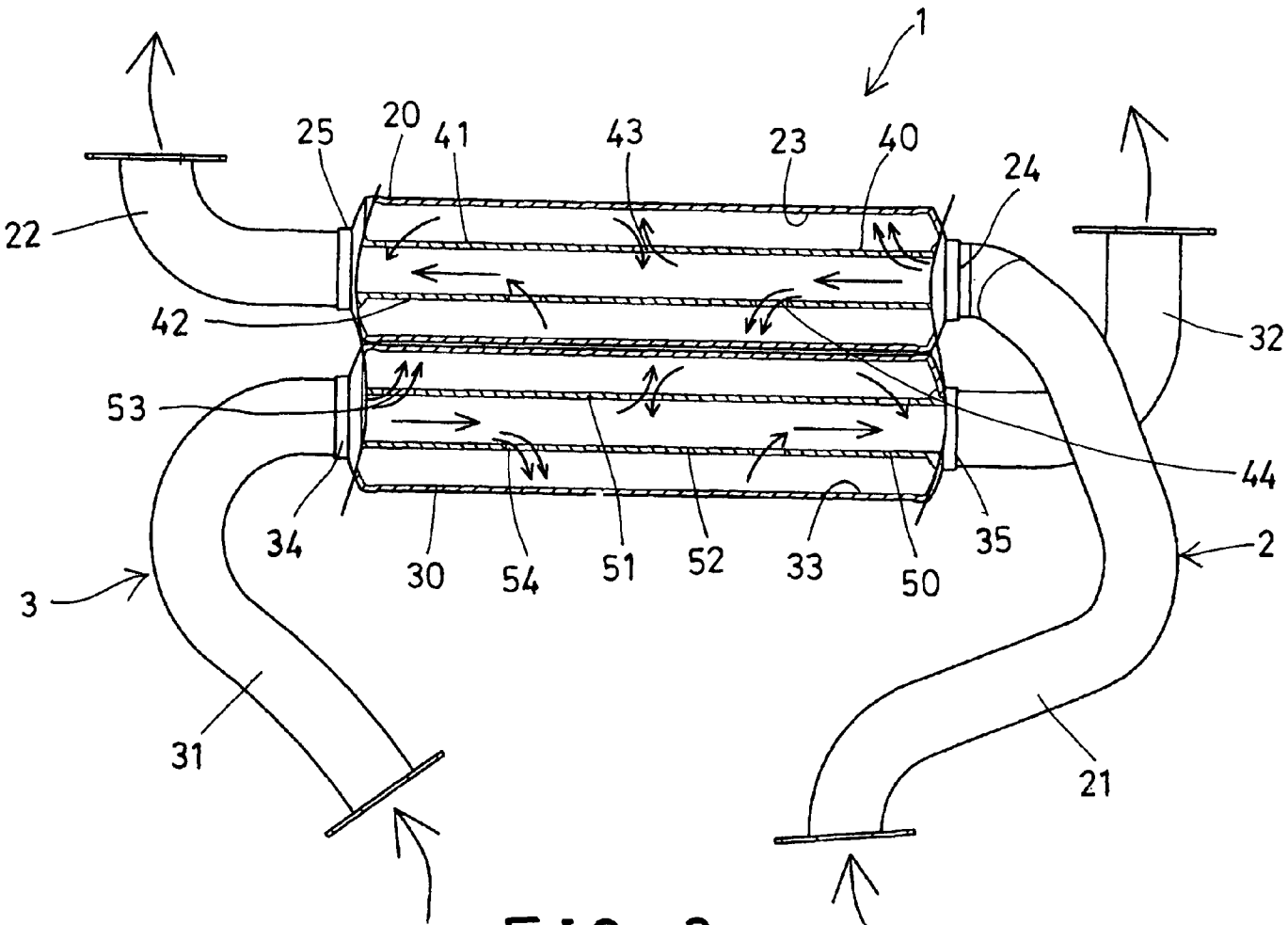
FIG. 2 is a top plan schematic view of the muffler combination, in which a portion of the muffler has been cut off for showing the inner structure of the muffler.
Figure 3:
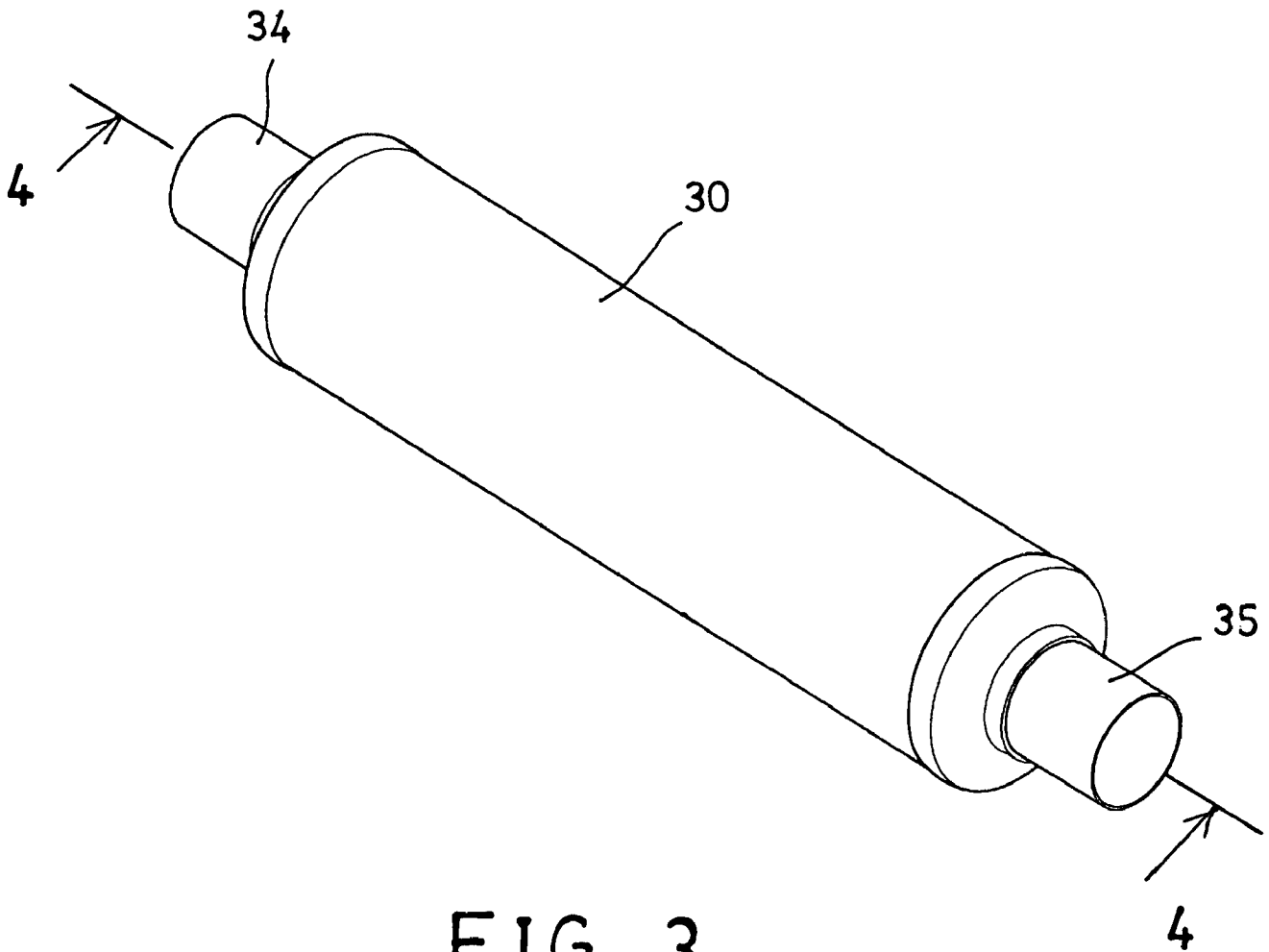
FIG. 3 is a partial perspective view illustrating a portion of the muffler combination.
Figure 4:
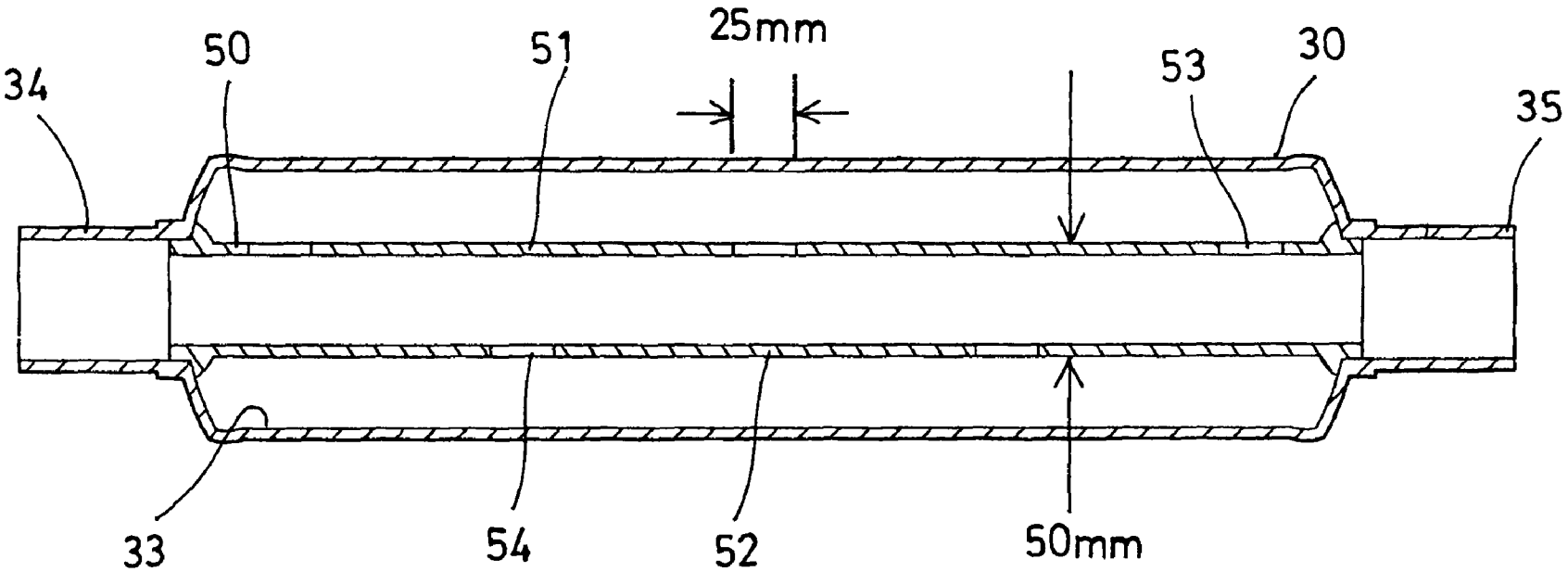
FIG. 4 is a cross sectional view of the muffler combination, taken along lines 4-4 of FIG. 3.
Figure 5:
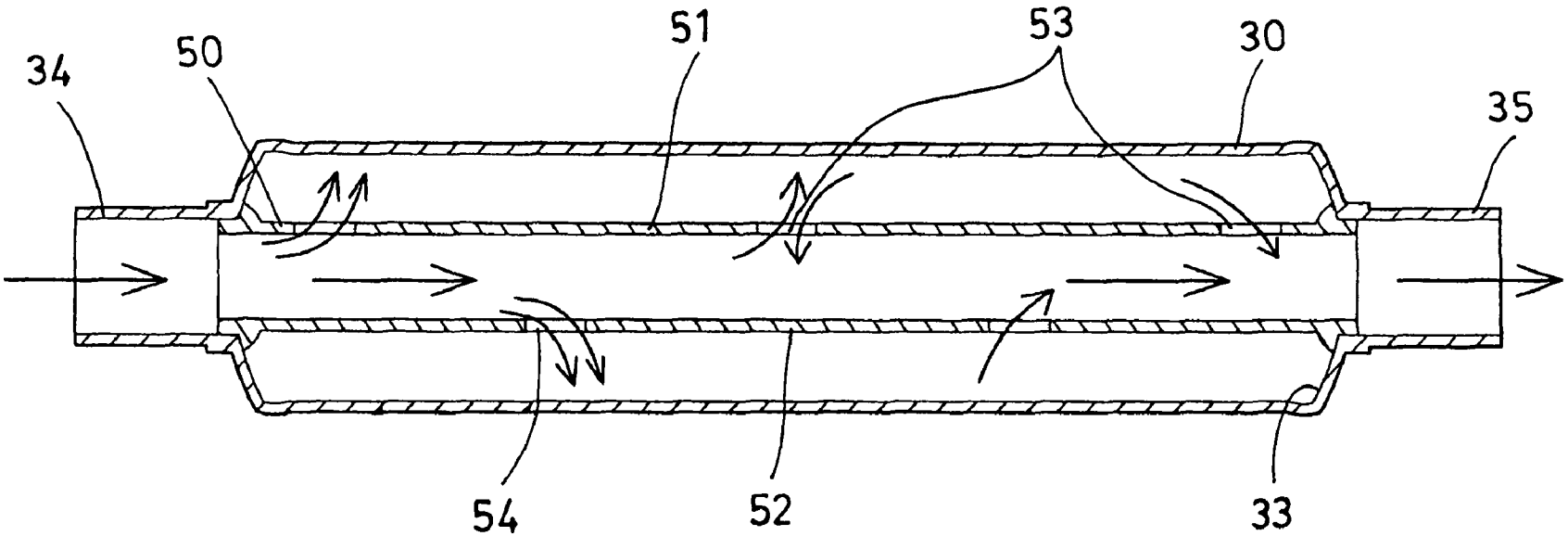
FIG. 5 is a cross sectional view similar to FIG. 4, illustrating the operation of the muffler combination.

As shown in FIGS. 2 and 5, much more exhaust gas will be allowed to flow through the openings 43, 53 of the housings 40, 50 and into the chamber 23, 33 of the cylindrical shell 20, 30, and relatively less exhaust gas will be allowed to flow through the orifices 44, 54 of the housings 40, 50 and into the chamber 23, 33 of the cylindrical shell 20, 30. As shown in FIG. 4, it is preferable that the housing 40, 50 includes an inner or outer diameter of about 50 mm, and the openings 43, 53 and/or the orifices 44, 54 of the housings 40, 50 include a diameter of about 25 mm which is about one-half of the inner or outer diameter of the housing 40, 50.

In operation, as shown in FIG. 2, the exhaust gas from the tail or exhaust pipe of the vehicle may flow into the inlet tube 21, 31 of the cylindrical shell 20, 30 respectively and then may flow into the housings 40, 50 respectively, and then may partially flow through the openings 43, 53 and the orifices 44, 54 of the housings 40, 50 and into the chamber 23, 33 of the cylindrical shell 20, 30, and may also partially flow out through the outlet tube 22, 32 directly, for suitably reducing the sound or noise that may be generated by the muffler and for suitably facilitating the outward flowing of the exhaust gas through the muffler.

Accordingly, the muffler combination in accordance with the present invention includes an improved structure for suitably reducing the sound or noise that may be generated by the muffler and for suitably facilitating the outward flowing of the exhaust gas.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A muffler combination comprising:

a first pipe unit including a first cylindrical shell having a first chamber formed therein, and including an entrance and an exit, and including an inlet tube connected to said entrance, and including an outlet tube connected to said exit, and including a first housing engaged in said first chamber of said first cylindrical shell, said first housing including a first side having three openings formed therein and including a second side having two orifices formed therein, and a second pipe unit including a second cylindrical shell having a second chamber formed therein, and including an entrance and an exit, and including an inlet tube connected to said entrance, and including an outlet tube connected to said exit, and including a second housing engaged in said second chamber of said second cylindrical shell, said second housing including a first side having three openings formed therein and including a second side having two orifices formed therein, and said first cylindrical shell and said second cylindrical shell being disposed parallel to each other, and said entrance and said inlet tube of said first cylindrical shell being located closer to said exit and said outlet tube of said second cylindrical shell, and said entrance and said inlet tube of said second cylindrical shell being located closer to said exit and said outlet tube of said first cylindrical shell.

2. The muffler combination as claimed in claim 1, wherein said openings of said first housing include a diameter of about one-half of a diameter of said first housing.

3. The muffler combination as claimed in claim 1, wherein said openings of said second housing include a diameter of about one-half of a diameter of said second housing.

4. The muffler combination as claimed in claim 1, wherein said orifices of said first housing include a diameter of about one-half of a diameter of said first housing.

5. The muffler combination as claimed in claim 1, wherein said orifices of said second housing include a diameter of about one-half of a diameter of said second housing.

* * * * *